United States Patent [19]

Meikle

[11] 4,026,080

[45] May 31, 1977

[54] FIELD ANCHOR

[76] Inventor: Lee B. Meikle, Rte. 1, Box 49, Fowler, Ohio 44418

[22] Filed: May 12, 1976

[21] Appl. No.: 685,622

[52] U.S. Cl. ..... 52/159
[51] Int. Cl.[2] ..... E02D 5/74
[58] Field of Search ..... 52/155–165

[56] References Cited

UNITED STATES PATENTS

| | | | |
|---|---|---|---|
| 2,191,124 | 2/1940 | Warmka | 52/158 |
| 3,216,159 | 11/1965 | Rooker | 52/158 |

FOREIGN PATENTS OR APPLICATIONS

| | | | |
|---|---|---|---|
| 515,575 | 4/1921 | France | 52/157 |

*Primary Examiner*—Price C. Faw, Jr.
*Assistant Examiner*—James L. Ridgill, Jr.
*Attorney, Agent, or Firm*—Webster B. Harpman

[57] ABSTRACT

A field anchor consisting of an anchor post, a horizontal tow bar attached to the post midway between its ends and a diagonally positioned compression brace extends between the uppermost end of the anchor post and the tow bar whereby movement imparted the horizontal tow bar will pull the anchor post into the ground in a field or the like to provide an anchor such as useful in attaching a cable and winch to pull a vehicle toward the anchor.

5 Claims, 4 Drawing Figures

FIELD ANCHOR

BACKGROUND OF THE INVENTION

1. Field of the Invention

This invention relates to field or ground anchors which may be engaged in the ground and attached to a cable and a winch on a vehicle to pull the vehicle toward the anchor.

2. Description of the Prior Art

Prior field anchors have comprised various anchor members of differing configurations with different attachments to which a towing cable could be affixed so as to attempt to set the anchor in the ground. See for example U.S. Pat. Nos. 1,138,915, 1,316,323, 3,425,174 and 3,500,598. This invention eliminates the uncertainties in the prior art devices and provides a field anchor which is arranged to drive the anchor member into the ground positively due to the application of the driving force thereto by the novel arrangement thereof.

SUMMARY OF THE INVENTION

A field anchor comprises an angularly positioned ground engaging post having a ground engaging configuration on its lower end and a horizontally disposed tow bar affixed thereto inwardly of its ends together with a coupling on the tow bar by which a towing cable may be attached. A compression brace extends between the horizontally disposed tow bar and the upper end of the ground engaging post, the parts being secured to one another to form a rigid structure so that longitudinal movement imparted the tow bar through the coupling thereof will move the ground engaging post into the ground until the tow bar portion of the device engages the surface of the ground whereupon the field anchor can be used in connection with a cable and a winch as for example in pulling a vehicle through an otherwise impassable area.

DESCRIPTION OF THE PREFERRED EMBODIMENT

Figure 1:
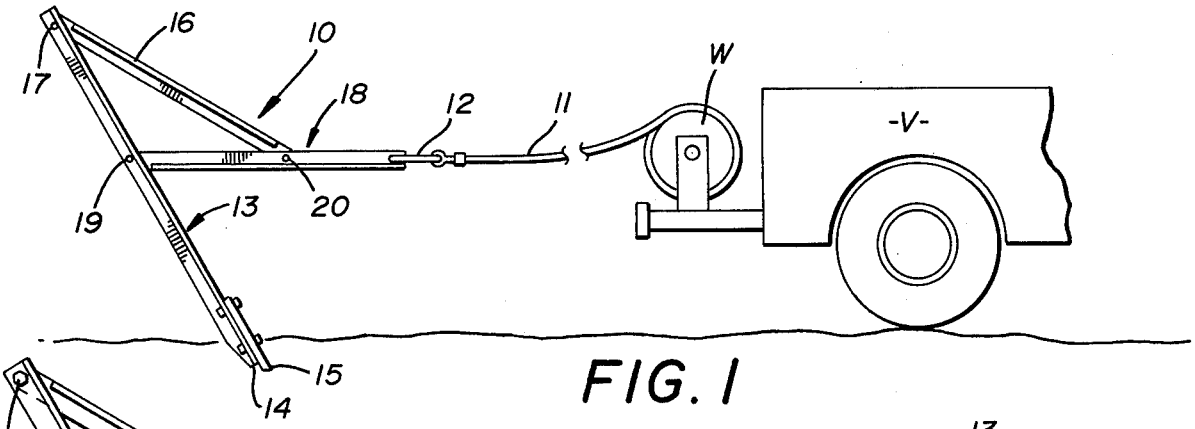
FIG. 1 is a side elevation with parts broken away illustrating the field anchor, a portion of a vehicle and a winch and a cable connected thereto.

By referring to the drawings and FIG. 1 in particular, it will be seen that a field anchor generally indicated by the numeral 10 is shown in the left portion of FIG. 1 with a cable 11 attached to a coupling 12 thereon and extending to a winch W on a vehicle V. The field anchor 10 comprises an angularly positioned post 13, the lower end 14 of which is pointed and to which is attached a diamond shaped plate 15. The upper end of the post 13 is attached to a diagonally positioned compression brace 16 as by a fastener 17 and a horizontal bar 18 is attached to the post 13 inwardly from its uppermost end by a fastener 19 and is secured to the lower end of the diagonally positioned compression brace 16 at a point substantially midway of the horizontal bar 18 as by a fastener 20. A coupling 12 is secured to the outer or free end of the horizontal bar 18 and it will thus be seen that when the winch W on the vehicle V is energized the cable 11 will be drawn toward the vehicle imparting longitudinal movement to the horizontal bar 18 which will cause the pointed end 14 of the post 13 and the diamond shaped plate 15 thereon to engage the ground and dig itself into the same as the pulling motion continues. The action will stop when the horizontal bar 18 reaches the ground surface or prior thereto if the resistance of the field anchor is sufficient to move the vehicle toward the same with a lesser penetration of the ground.

Figure 2:
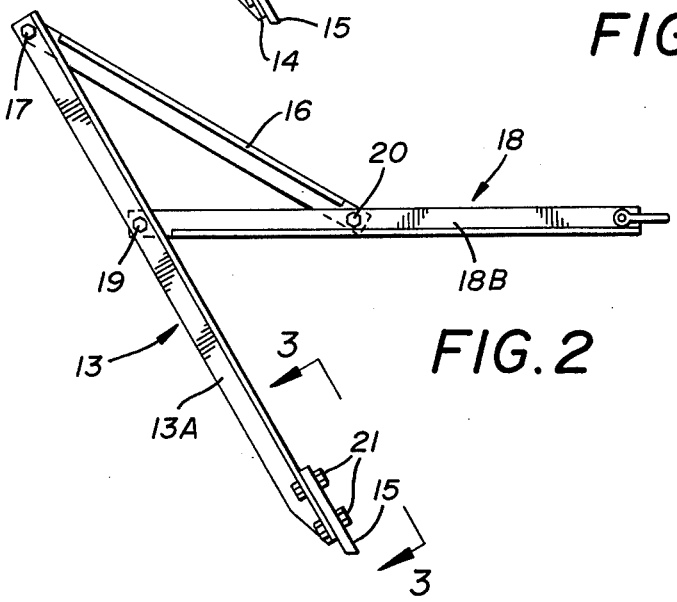
FIG. 2 is an enlarged side elevation of the field anchor seen in FIG. 1.
Figure 3:
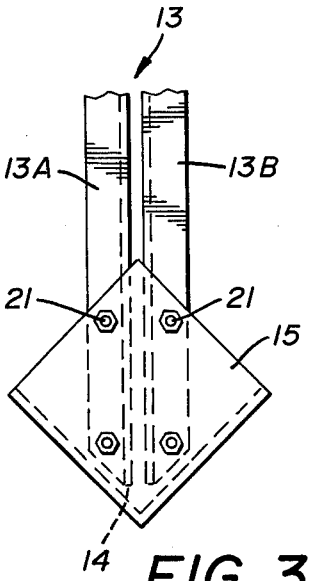
FIG. 3 is a plan view on line 3—3 of FIG. 2.
Figure 4:
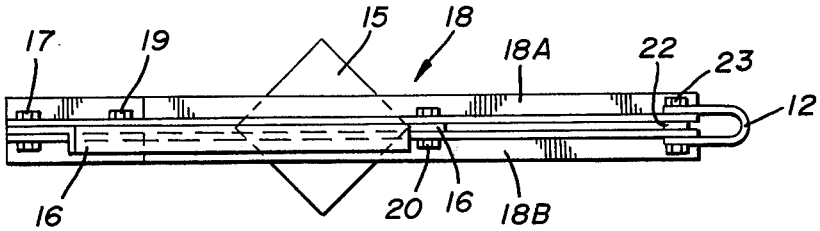
FIG. 4 is a top plan view of the field anchor seen in FIG. 2.

By referring now to FIGS. 2, 3 and 4 of the drawings, it will be seen that the post 13 is formed of a pair of oppositely disposed angle members 13A and 13B positioned in spaced parallel relation as best seen in FIG. 3 of the drawings, with a plurality of fasteners 21 securing the diamond shaped plate 15 to the lower pointed end 14 and maintaining the spaced relation of the members 13A and 13B.

The horizontal bar 18 is also formed of a pair of spaced parallel angle members 18A and 18B as best seen in FIG. 4 of the drawings with spacers 22 and fasteners 23 joining the angle members 18A and 18B to one another and attaching the coupling 12. The opposite ends of the angle members 18A and 18B have portions of their horizontal flanges cut away so that their vertically disposed flanges may be positioned between the spaced angle members 13A and 13B of the post 13 and secured therebetween by the fastener 19.

The diagonally positioned compression brace 16 comprises a single angle member having portions of its substantially horizontal flange cut away at each end so that the vertical portions thereof can be positioned between the members 13A and 13B of the post 13 and secured by the fastener 17 and so that the opposite or lower end thereof can be positioned between the spaced angle members 18A and 18B and be secured therebetween by the fastener 20.

The field anchor thus disclosed forms an extremely rigid and durable device that may be positioned in a desired location such as in firm ground by engaging the point 14 thereof as shown in FIG. 1 of the drawings and then moved as by the winch W and cable 11 so that the post 13 digs itself into the ground and provides a suitable ground anchor as desired. It will occur to those skilled in the art that the post 13 must maintain its angular relation to the ground surface by reason of the horizontal positioning of the horizontal bar 18 which will maintain its horizontal position when placed under tension as by the winch W and cable 11 and by reason of the diagonally positioned compression brace 16 which holds the upper end of the post 13 in the desired spaced relation to the point of attachment of the horizontal bar 18 whereby the pulling force imparted to the horizontal bar 18 causes the angularly positioned post 13 to dig itself into the ground with the compression brace 16 resisting any effort of the post to change its angular relation to the horizontal bar 18.

The above described field anchor provides a relatively lightweight, highly efficient device for its indicated purpose and has been found in use to anchor itself quickly and easily in various soil conditions and to provide a suitable anchor to permit a vehicle to be winched toward the same through an otherwise impassable ground condition.

Although but one embodiment of the present invention has been illustrated and described, it will be apparent to those skilled in the art that various changes and modifications may be made therein without departing from the spirit of the invention and having thus described my invention

What I claim is:

1. A field anchor comprising an angularly disposed ground engaging post and a horizontal bar having one of its ends attached to said post substantially midway between the ends of the post, said post and said bar each formed of a pair of spaced parallel angle members, coupling means on the other end of said horizontal bar for the reception of a cable and a compression brace positioned between the uppermost end of the post and the middle portion of the horizontal bar, the lower end of the post having a pointed configuration and a plate positioned transversely thereof, fasteners joining said plate and said angle members of said post, portions of said one end of said horizontal bar and one end of said compression brace positioned between said angle members of said post and fasteners attaching the same thereto.

2. The field anchor of claim 1 and wherein the post, horizontal bar and compression brace are rigid members in fixed relation to one another.

3. The field anchor set forth in claim 1 and wherein said spaced parallel angle members of said post and horizontal bar are oppositely disposed with their horizontal flanges outturned.

4. The field anchor of claim 1 and wherein the compression brace and portions of the post and horizontal bar are arranged to substantially form a triangle.

5. The field anchor of claim 1 and wherein the compression brace and and portions of the post and horizontal bar are arranged to substantially form a triangle on and above the plane of the horizontal bar.

* * * * *